US011088469B1

(12) United States Patent
Chiang

(10) Patent No.: US 11,088,469 B1
(45) Date of Patent: Aug. 10, 2021

(54) COMMON ANTENNA ASSEMBLY AND COMMON ANTENNA STRUCTURE

(71) Applicant: AUDEN TECHNO CORP., Taoyuan (TW)

(72) Inventor: Chi-Ming Chiang, Taoyuan (TW)

(73) Assignee: AUDEN TECHNO CORP., Taoyuan (TW)

( * ) Notice: Subject to any disclaimer, the term of this patent is extended or adjusted under 35 U.S.C. 154(b) by 0 days.

(21) Appl. No.: 16/839,528

(22) Filed: Apr. 3, 2020

(51) Int. Cl.

| | |
|---|---|
| ***H01Q 1/36*** | (2006.01) |
| ***H01Q 21/06*** | (2006.01) |
| ***H01Q 21/18*** | (2006.01) |
| ***H01Q 1/48*** | (2006.01) |
| ***H01Q 5/335*** | (2015.01) |

(52) U.S. Cl.
CPC ..... *H01Q 21/065* (2013.01); *H01Q 1/48* (2013.01); *H01Q 5/335* (2015.01); *H01Q 21/18* (2013.01)

(58) Field of Classification Search
CPC ..... H01Q 21/065; H01Q 21/18; H01Q 5/335; H01Q 1/48
USPC ..... 343/700 R
See application file for complete search history.

(56) References Cited

U.S. PATENT DOCUMENTS 6,114,998 A * 9/2000 Schefte ..... H01Q 9/0414 343/700 MS
6,870,503 B2 * 3/2005 Mohamadi ..... H01Q 1/36 342/372
6,885,344 B2 * 4/2005 Mohamadi ..... H01Q 1/38 343/700 MS
7,126,554 B2 * 10/2006 Mohamadi ..... H01Q 1/36 343/772
10,003,132 B2 * 6/2018 Du ..... H01Q 5/30
2004/0095256 A1 * 5/2004 Mohamadi ..... G08C 17/02 340/870.18
2004/0095287 A1 * 5/2004 Mohamadi ..... H01Q 9/0457 343/824
2004/0100405 A1 * 5/2004 Mohamadi ..... H01Q 21/065 343/700 MS
2005/0116864 A1 * 6/2005 Mohamadi ..... H01Q 9/0457 343/700 MS
2016/0365647 A1 * 12/2016 Du ..... H01Q 25/00
2019/0334238 A1 * 10/2019 Honda ..... H01Q 3/36

* cited by examiner

*Primary Examiner* — Jean B Jeanglaude
(74) *Attorney, Agent, or Firm* — Li & Cai Intellectual Property (USA) Office

(57) ABSTRACT

A common antenna assembly and a common antenna structure are provided. The common antenna assembly includes a substrate, a plurality of patch antenna disposed on the substrate, a matching network disposed on the plurality of patch antennas, and a plurality of phase shifters electrically connected to the matching network. The substrate defines a first direction and a second direction that are perpendicular to each other. The patch antennas are defined into a plurality of antenna units. Each of the antenna units has four of the patch antennas. In each of the antenna units along the first direction, any one of the antenna units shares a longitudinal common antenna unit with each of the adjacent antenna units. In each of the antenna units along the second direction, any one of the antenna units shares a horizontal common antenna unit with each of the adjacent antenna units.

10 Claims, 7 Drawing Sheets

COMMON ANTENNA ASSEMBLY AND COMMON ANTENNA STRUCTURE

FIELD OF THE DISCLOSURE

The present disclosure relates to an antenna, and more particularly to a common antenna assembly and common antenna structure.

BACKGROUND OF THE DISCLOSURE

A conventional antenna assembly includes a substrate, a plurality of antennas located on the substrate, and a plurality of phase shifters electrically coupled to the antennas. The antennas are electrically coupled to each other through an electric circuit, and can be used to be fed by the corresponding phase shifter, so that the phase can be changed to achieve the direction switching of the field beam. However, under the same area, the maximum number of the antennas arranged on the substrate of the conventional antenna assembly is limited (or fixed). The gain effect of the antenna assembly is directly proportional to the number of the antennas. In other words, the gain effect of the conventional antenna assembly under the same unit area has been limited, and has little room for improvement.

SUMMARY OF THE DISCLOSURE

In response to the above-referenced technical inadequacies, the present disclosure provides a common antenna assembly and a common antenna structure to effectively improve on the issues associated with conventional antenna assemblies.

In one aspect, the present disclosure provides a common antenna assembly, which includes a substrate, a plurality of patch antennas, a matching network, and a plurality of phase shifters. The substrate defines a first direction and a second direction that is perpendicular to the first direction. The patch antennas are uniformly distributed on the substrate. The patch antennas are arranged along the first direction and the second direction, and the patch antennas are defined into a plurality of antenna units that are arranged in a plurality of rows or a plurality of columns. Each of the antenna units includes four of the patch antennas arranged in two rows parallel to the first direction and two columns parallel to the second direction. In the antenna units of any one of the rows parallel to the first direction, any two of the antenna units adjacent to each other jointly share a longitudinal common antenna unit that is defined by two adjoining ones of the patch antennas, and the longitudinal common antenna unit is arranged along the second direction. In the antenna units of any one of the columns parallel to the second direction, any two of the antenna units adjacent to each other jointly share a horizontal common antenna unit that is defined by two adjoining ones of the patch antennas, and the horizontal common antenna unit is arranged along the first direction. The matching network is electrically coupled to the patch antennas. The phase shifters are respectively and electrically coupled to portions of the matching network that respectively correspond in position to the antenna units, so that each of the phase shifters is capable of being used to adjust phases generated from the four of the patch antennas of the corresponding antenna unit. A number of the phase shifters are equal to a number of the antenna units.

In one aspect, the present disclosure provides a common antenna structure, which includes a substrate, a plurality of patch antennas, and a plurality of phase shifters. The substrate defines a first direction and a second direction that is perpendicular to the first direction. The patch antennas are uniformly distributed on the substrate. The patch antennas are arranged along the first direction and the second direction, and the patch antennas are defined into a plurality of antenna units that are arranged in a plurality of rows or a plurality of columns. Each of the antenna units includes four of the patch antennas arranged in two rows parallel to the first direction and two columns parallel to the second direction. In the antenna units of any one of the rows parallel to the first direction, any two of the antenna units adjacent to each other jointly share a longitudinal common antenna unit that is defined by two adjoining ones of the patch antennas, and the longitudinal common antenna unit is arranged along the second direction. In the antenna units of any one of the columns parallel to the second direction, any two of the antenna units adjacent to each other jointly share a horizontal common antenna unit that is defined by two adjoining ones of the patch antennas, and the horizontal common antenna unit is arranged along the first direction. The phase shifters are respectively and electrically coupled to the antenna units, so that each of the phase shifters is capable of being used to adjust phases generated from the four of the patch antennas of the corresponding antenna unit. A number of the phase shifters are equal to a number of the antenna units.

Therefore, the common antenna assembly and the common antenna structure of the present disclosure, through the design of any one of the antenna units and the antenna unit adjacent to each other sharing the longitudinal common antenna unit and the horizontal common antenna unit, the present disclosure provides a better gain effect under the same unit area (that is, compared with the substrate under the same area).

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
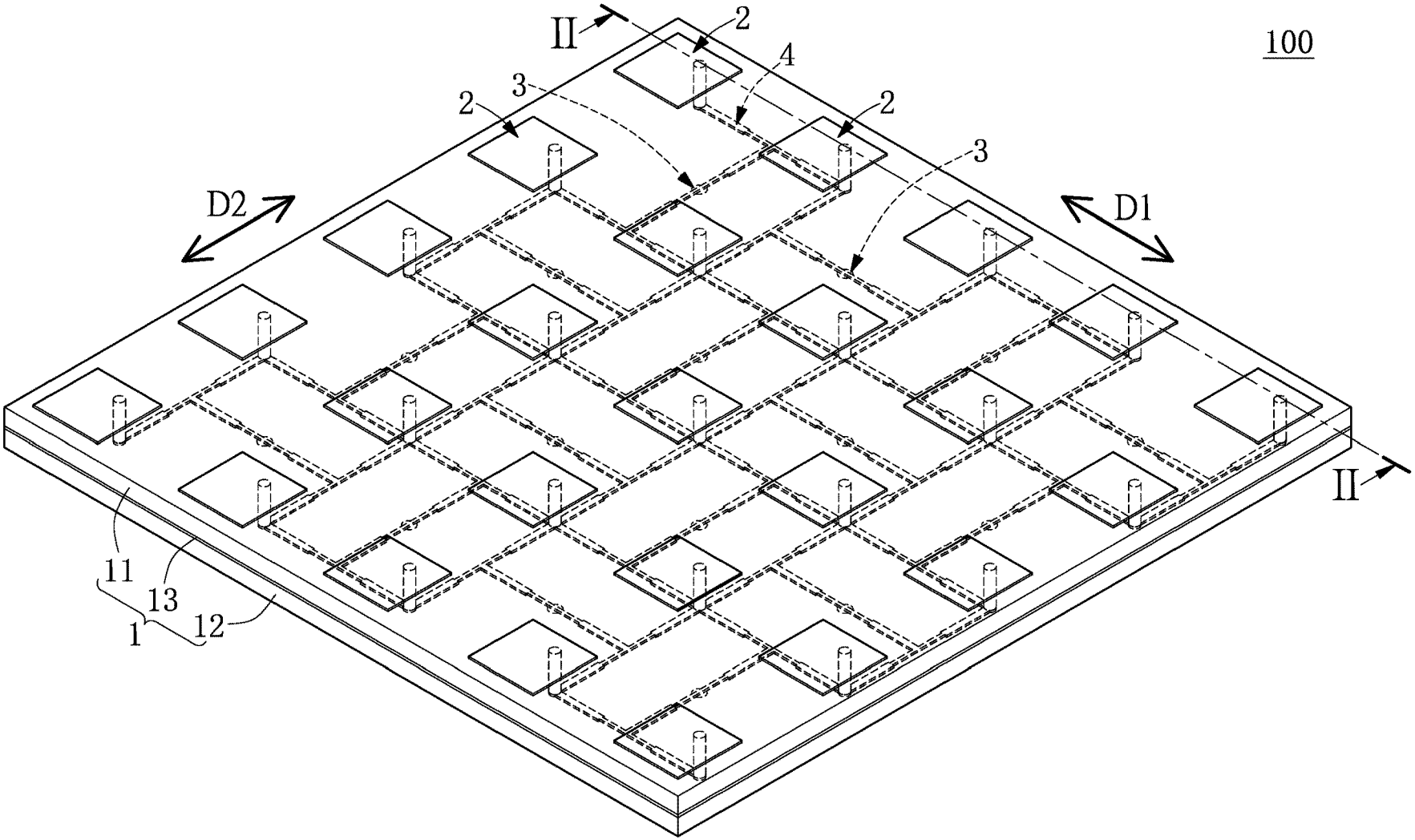
FIG. 1 is a perspective view of a common antenna assembly of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 7, an embodiment of the present disclosure provides a common antenna assembly 100 including a substrate 1, a plurality of patch antennas 2 disposed on the substrate 1, a matching network 4 electrically coupled to the patch antennas 2, and a plurality of phase shifters 3 that are electrically coupled to the matching network 4. Specifically, each of the patch antennas 2 is fed through the corresponding phase shifter 3 to change the phase to achieve the direction switching of a field beam. It should be noted that the common antenna assembly 100 in the present embodiment is a monopole antenna structure, but the present disclosure is not limited thereto. For example, in other embodiments of the present disclosure, a dipole antenna structure can be composed of the two common antenna assemblies 100.

It should be noted that the substrate 1, the patch antennas 2, the phase shifters 3, and the matching network 4 in the present embodiment are jointly defined into the common antenna assembly 100, but the present disclosure is not limited thereto. For example, the substrate 1, the patch antennas 2, and the phase shifters 3 may be jointly defined into a common antenna structure that can be independently used (e.g., sold) or can be used in cooperation with other components. The following description describes the structure and connection relationship of each component of the common antenna assembly 100.

Figure 2:
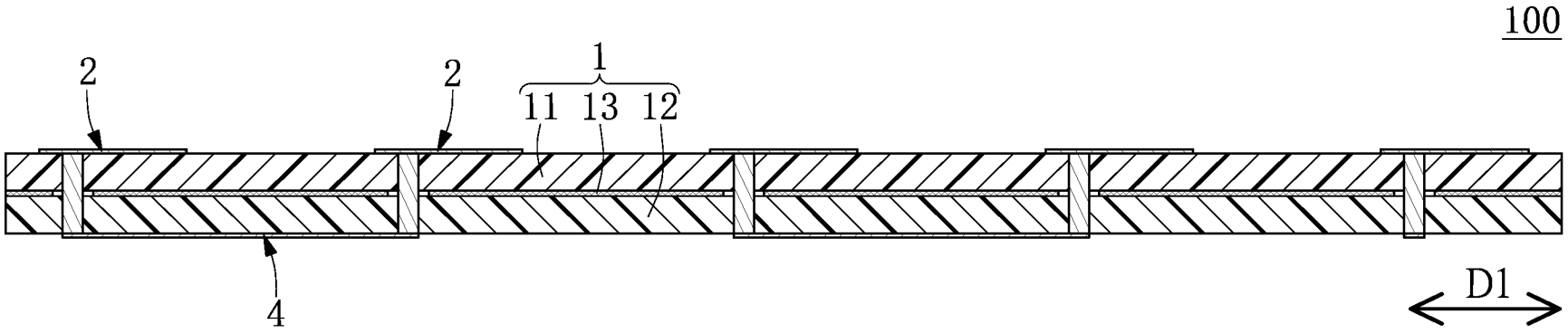
FIG. 2 is a cross-sectional view taken along line II-II of FIG. 1.

Referring to FIG. 1 and FIG. 2, the substrate 1 defines a first direction D1 and a second direction D2 that is perpendicular to the first direction D1. Specifically, the first direction D1 is the left-right direction in FIG. 2, and the second direction D2 is the up-down direction in FIG. 2. Further, the substrate 1 is a rectangular multilayer board structure in the present embodiment. The substrate 1 includes an antenna layer 11 provided with the patch antennas 2 and a circuit layer 12 located on an opposite side of the antenna layer 11. In the present embodiment, the antenna layer 11 may be a copper foil substrate (e.g., FR-4), and the circuit layer 12 may be a laminated board (e.g., Rogers 4350), but the present disclosure is not limited thereto. Further, the substrate 1 includes a ground layer 13 arranged between the antenna layer 11 and the circuit layer 12, and the ground layer 13 is configured to be electrically coupled with a ground line (not shown in the figures).

Figure 3:
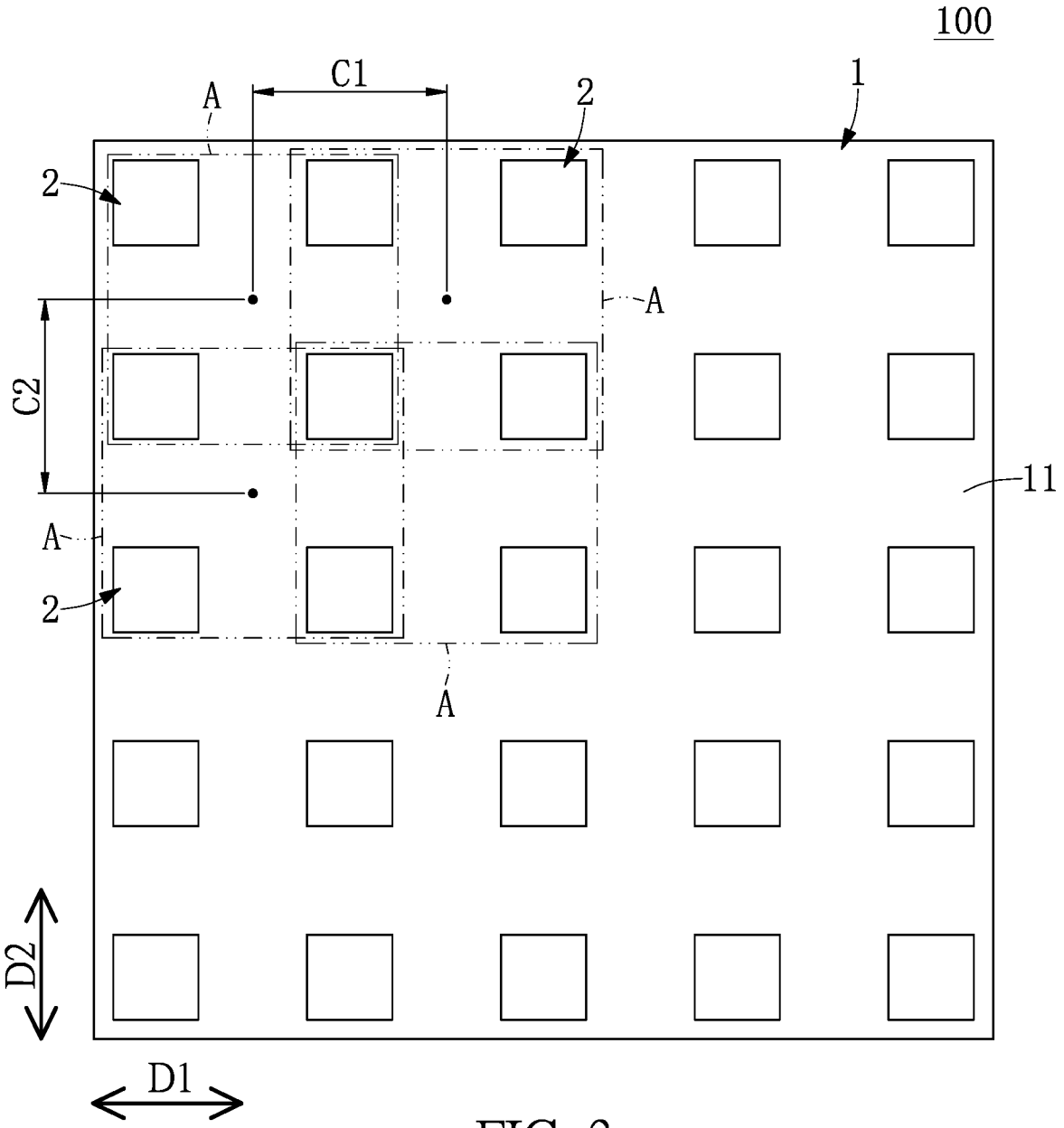
FIG. 3 is a top view of the common antenna assembly of the present disclosure.
Figure 4:
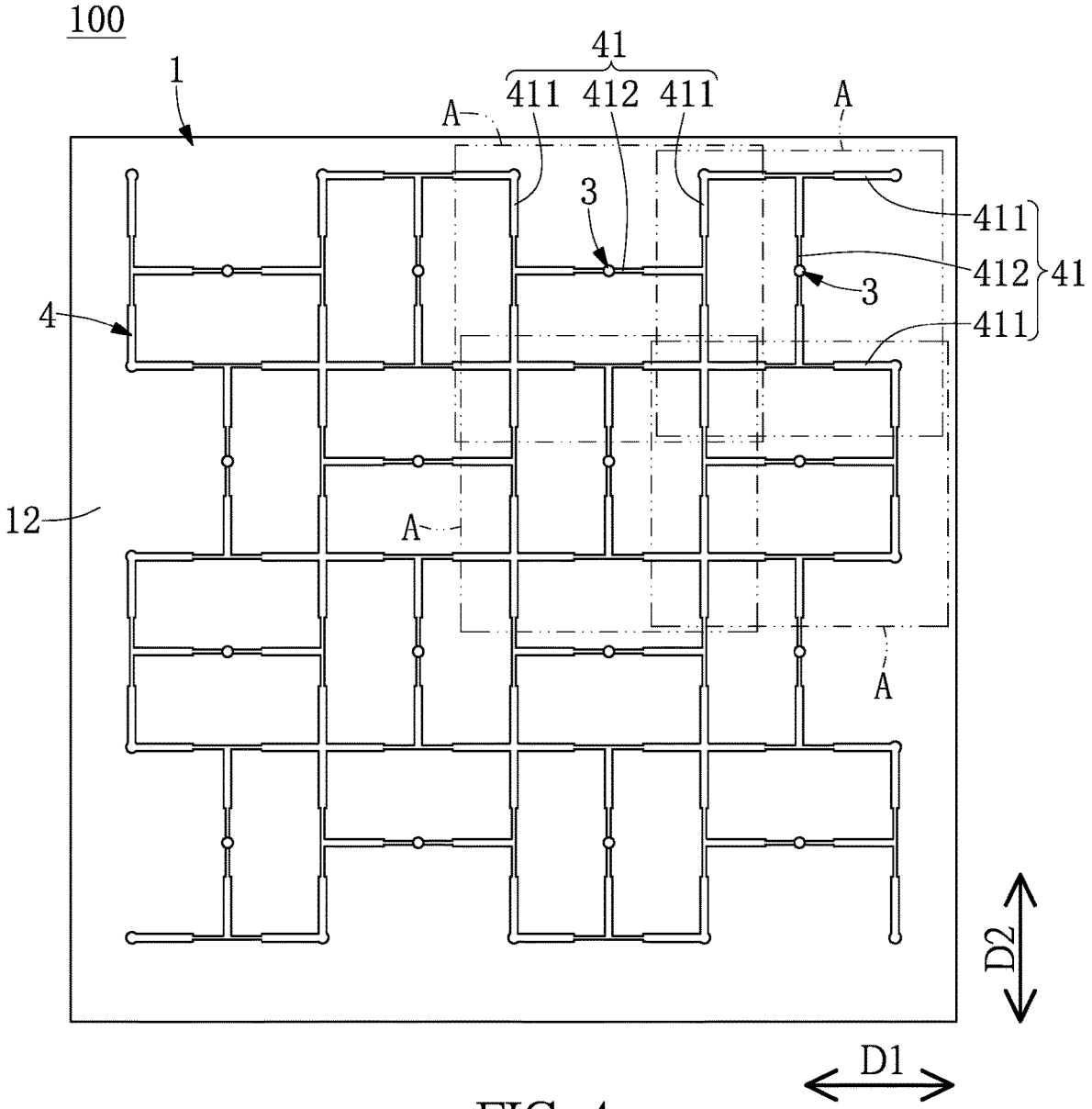
FIG. 4 is a bottom view of the common antenna assembly of the present disclosure.
Figure 5:
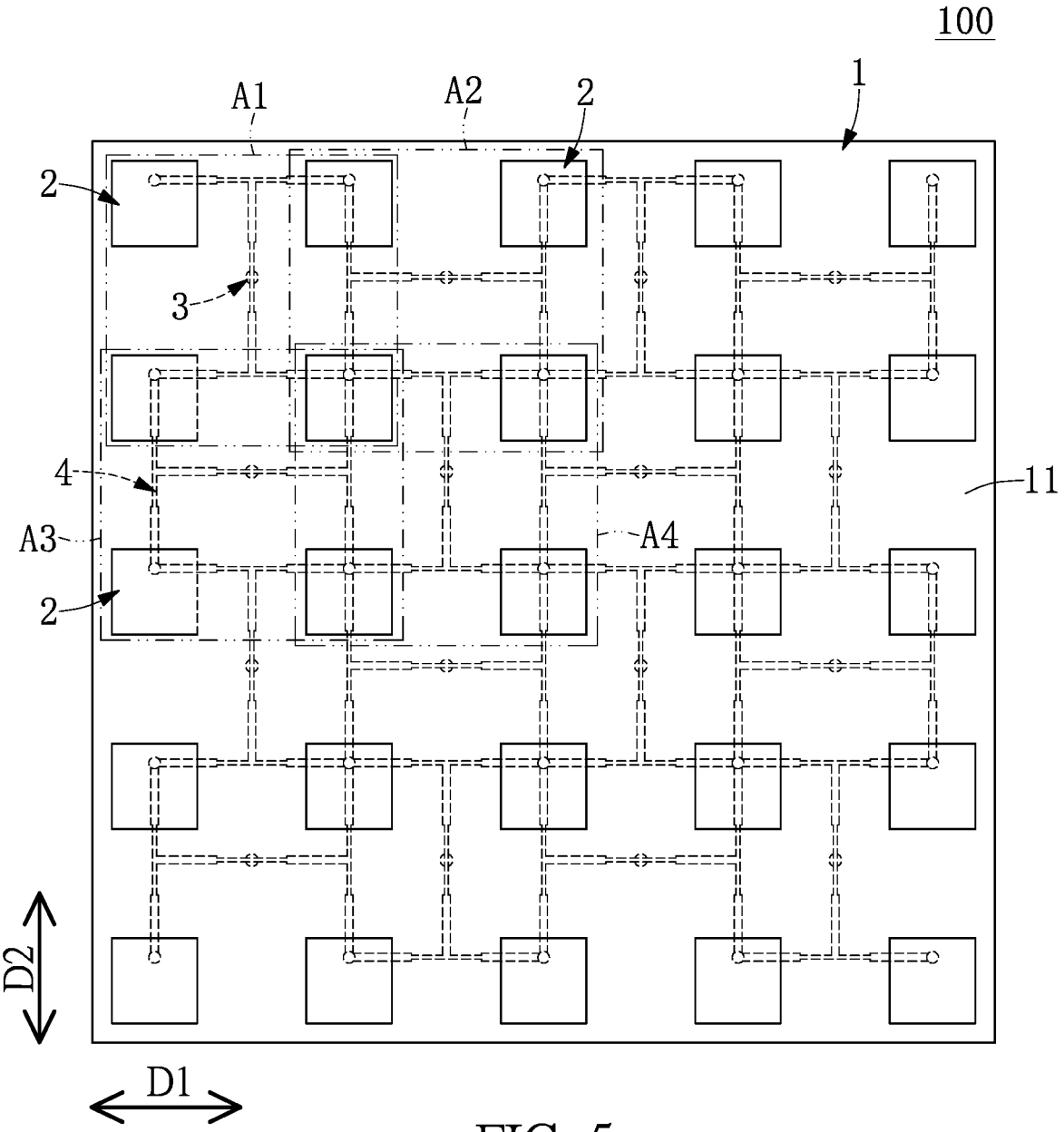
FIG. 5 is a planar view of the common antenna assembly of the present disclosure.

Referring to FIG. 3 to FIG. 5, the patch antennas 2 are uniformly distributed on the substrate 1. The patch antennas 2 are arranged along the first direction D1 and the second direction D2, and the patch antennas 2 are defined into a plurality of antenna units A that are arranged in a plurality of rows or a plurality of columns. Each of the antenna units A includes four of the patch antennas 2 arranged in two rows parallel to the first direction D1 and two columns parallel to the second direction D2. In other words, the patch antennas 2 are located on the antenna layer 11 and form a two by two matrix (such as a checkerboard shape).

Further, in the antenna units A of any one of the rows parallel to the first direction D1, any two of the antenna units A adjacent to each other share a longitudinal common antenna unit that is defined by two adjoining ones of the patch antennas 2, and the longitudinal common antenna unit is arranged along the second direction D2. In the antenna units A of any one of the columns parallel to the second direction D2, any two of the antenna units A adjacent to each other share a horizontal common antenna unit that is defined by two adjoining ones of the patch antennas 2, and the horizontal common antenna unit is arranged along the first direction D1.

In other words, the antenna units A of the present disclosure are arranged in M of rows along the first direction D1 N of columns along the second direction D2, so that the antenna units A form an M by N matrix on the substrate 1. The total number of the patch antennas 2 of the present disclosure will be (M+1) times (N+1). The following example is exemplified with four of the adjacent antenna units A being located on the substrate 1 to provide a more detailed description, but the present disclosure is not limited thereto.

Figure 6:
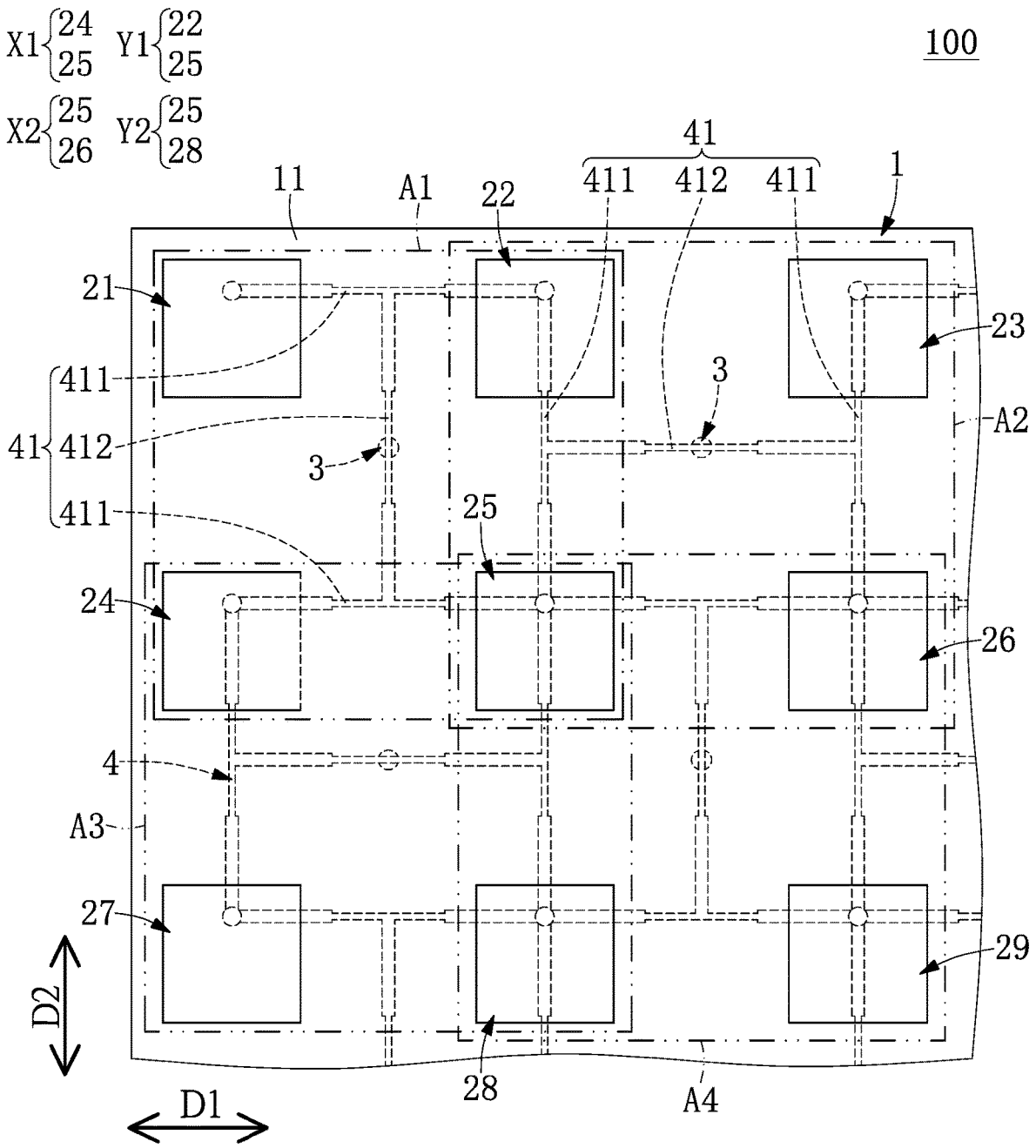
FIG. 6 is a partial planar view of FIG. 5.

Referring to FIG. 3, FIG. 5, and FIG. 6, the four of antenna units A include nine of the patch antennas 2 in total, and the nine of patch antennas 2 are arranged in a three-by-three matrix configuration. Referring to FIG. 5, the nine of the patch antennas 2 are sequentially defined from left to right and top to bottom as a first patch antenna 21, a second patch antenna 22, a third patch antenna 23, a fourth patch antenna 24, a fifth patch antenna 25, a sixth patch antenna 26, a seventh patch antenna 27, an eighth patch antenna 28, and a ninth patch antenna 29. The four of antenna units A are sequentially defined from left to right and top to bottom in FIG. 5 as a first antenna unit A1, a second antenna unit A2, a third antenna unit A3, and a fourth antenna unit A4. The first antenna unit A1 and the second antenna unit A2 jointly share a first longitudinal common antenna unit Y1 composed of the second patch antenna 22 and the fifth patch antenna 25. The third antenna unit A3 and the fourth antenna unit A4 jointly share a second longitudinal common antenna unit Y2 composed of the fifth patch antenna 25 and the eight patch antenna 28. The first longitudinal common antenna unit Y1 and the second longitudinal common antenna unit Y2 jointly share the fifth patch antenna 25.

In addition, the first antenna unit A1 and the third antenna unit A3 jointly share a first horizontal common antenna unit X1 composed of the fourth patch antenna 24 and the fifth patch antenna 25. The second antenna unit A2 and the fourth antenna unit A4 jointly share a second horizontal common antenna unit X2 composed of the fifth patch antenna 25 and the sixth patch antenna 26. The first horizontal common antenna unit X1 and the second horizontal antenna unit X2 jointly share the fifth patch antenna 25. In other words, the first antenna unit A1, the second antenna unit A2, the third antenna unit A3, and the fourth antenna unit A4 simultaneously and jointly share the fifth patch antenna 25 located at the center of the 3 by 3 matrix.

It should be noted that although the foregoing description is explained by using only the four of antenna units A, the present disclosure is not limited to the number of the antenna units A. Specifically, the number of the antenna units A of the present disclosure can be infinitely expanded based on the above-mentioned concept.

Preferably, referring to FIG. 2, in the antenna units A of any one of the rows parallel to the first direction D1, center points of any two of the antenna units A adjacent to each other are spaced apart by a horizontal center distance C1 along the first direction D1. In the antenna units A of any one of the columns parallel to the second direction D2, center points of any two of the antenna units A adjacent to each other are spaced apart by a longitudinal center distance C2 along the second direction D2. The horizontal center distance C1 is equal to the longitudinal center distance C2. In addition, the common antenna assembly 100 is suitable for a transmission frequency band, and the longitudinal center distance C2 and the horizontal center distance C1 are 0.5 to 0.8 times the wavelength corresponding to a center frequency of the transmission frequency band.

Figure 7:
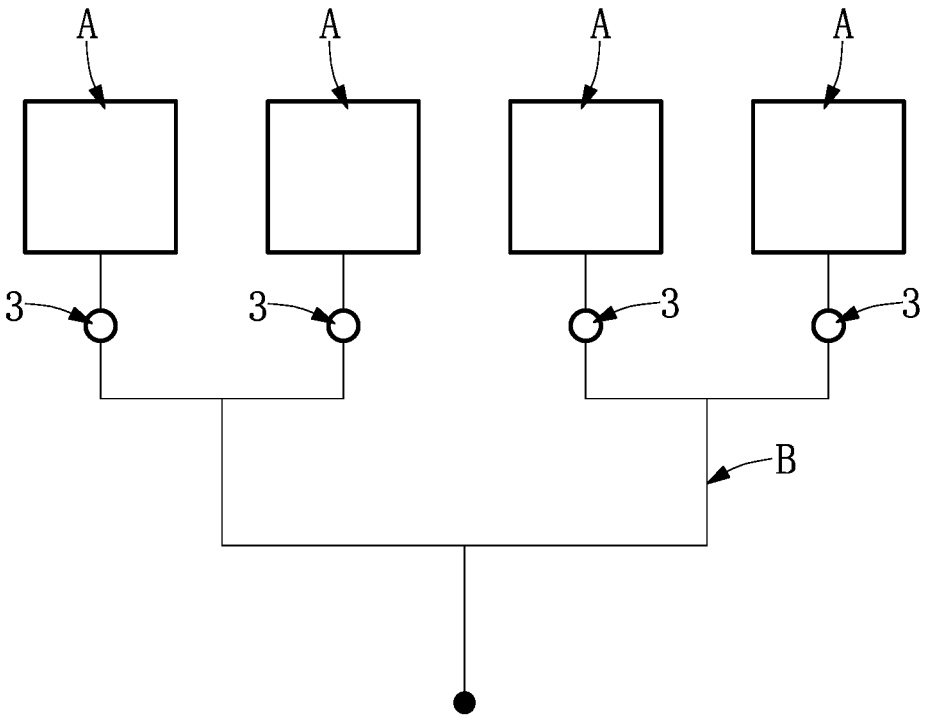
FIG. 7 is a schematic view showing the common antenna assembly is electrically coupled to a feed network.

Referring to FIG. 1, FIG. 2, and FIG. 5, the matching network 4 is disposed on the circuit layer 12, and the matching network 4 is electrically coupled to the patch antennas 2 by passing through the circuit layer 12 and the antenna layer 11. The matching network 4 is capable of being electrically coupled with a feed network B (as shown in FIG. 7).

Specifically, referring to FIG. 4 and FIG. 6, the matching network 4 has a plurality of partial circuits 41, each of the antenna units A is connected to one of the partial circuits 41. Each of the partial circuits 41 is in an H-shape, and any two of the partial circuits 41 adjacent to each other are arranged at 90 degrees from each other. In detail, each of the partial circuits 41 has two first segments 411 and a second segment 412 that is arranged between the two first segments 411. Two ends of each of the first segments 411 in each of the partial circuits 41 are electrically coupled to the corresponding antenna units A of the patch antennas 2, respectively. Two ends of the second segment 412 in each of the partial circuits 41 are electrically coupled to the two of the first segments 411 in the same one of the partial circuits 41, respectively.

The phase shifters 3 are respectively and electrically coupled to the antenna units A, so that each of the phase shifters 3 is capable of being used to adjust phases generated from the four of the patch antennas 2 of the corresponding antenna unit A. The number of the phase shifters 3 is equal to the number of the antenna units A. Specifically, in the present embodiment, each of the phase shifters 3 may be disposed on the second segment 412 of the corresponding partial circuit 41, and each of the phase shifters 3 is electrically coupled to the feeding network B (as shown in FIG. 7), but the present disclosure is not limited to that disclosed in the present embodiment.

In conclusion, the common antenna assembly 100 and the common antenna structure of the present disclosure, through the design of any one of the antenna units and the antenna unit adjacent to each other sharing the longitudinal common antenna unit and the horizontal common antenna unit, the present disclosure provides a better gain effect under the same unit area (that is, compared with the substrate under the same area).

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated.

Alternative embodiments will become apparent to those skilled in the art to which the present disclosure pertains without departing from its spirit and scope.

What is claimed is:

1. A common antenna assembly, comprising:

a substrate defining a first direction and a second direction that is perpendicular to the first direction;

a plurality of patch antennas uniformly distributed on the substrate, wherein the patch antennas are arranged along the first direction and the second direction, and the patch antennas are defined into a plurality of antenna units that are arranged in a plurality of rows or a plurality of columns, wherein each of the antenna units includes four of the patch antennas arranged in two rows parallel to the first direction and two columns parallel to the second direction, wherein in the antenna units of any one of the rows parallel to the first direction, any two of the antenna units adjacent to each other jointly share a longitudinal shared antenna unit that is defined by two adjoining ones of the patch antennas, and the longitudinal common antenna unit is arranged along the second direction, and wherein in the antenna units of any one of the columns parallel to the second direction, any two of the antenna units adjacent to each other jointly share a horizontal common antenna unit that is defined by two adjoining ones of the patch antennas, and the horizontal common antenna unit is arranged along the first direction;

a matching network electrically coupled to the patch antennas; and a plurality of phase shifters respectively and electrically coupled to portions of the matching network that respectively correspond in position to the antenna units, so that each of the phase shifters is capable of being used to adjust phases generated from the four of the patch antennas of the corresponding antenna unit, and wherein a number of the phase shifters is equal to a number of the antenna units.

2. The common antenna assembly according to claim 1, wherein in the antenna units of any one of the rows parallel to the first direction, center points of any two of the antenna units adjacent to each other are spaced apart by a horizontal center distance along the first direction, wherein in the antenna units of any one of the columns parallel to the second direction, center points of any two of the antenna units adjacent to each other are spaced apart by a longitudinal center distance along the second direction, and wherein the horizontal center distance is equal to the longitudinal center distance.

3. The common antenna assembly according to claim 2, wherein the common antenna assembly is suitable for a transmission frequency band, and each of the longitudinal center distance and the horizontal center distance is 0.5 to 0.8 times of a wavelength corresponding to a center frequency of the transmission frequency band.

4. The common antenna assembly according to claim 1, wherein the substrate includes an antenna layer provided with the patch antennas and a circuit layer located on an opposite side of the antenna layer, wherein the matching network is disposed on the circuit layer, and the matching network is electrically coupled to the patch antennas by passing through the circuit layer and the antenna layer, and wherein the matching network is capable of being electrically coupled with a feed network.

5. The common antenna assembly according to claim 4, wherein the substrate includes a ground layer arranged between the antenna layer and the circuit layer, and wherein the ground layer is configured to be electrically coupled to a ground line.

6. The common antenna assembly according to claim 4, wherein the matching network has a plurality of partial circuits, each of the antenna units is connected to one of the partial circuits, and wherein each of the partial circuits is in an H-shape, and any two of the partial circuits adjacent to each other are arranged at 90 degrees from each other.

7. The common antenna assembly according to claim 6, wherein each of the partial circuits has two first segments and a second segment that is arranged between the two first segments, wherein two ends of each of the first segments in each of the partial circuits are electrically coupled to the corresponding antenna units of the patch antennas, respectively, and wherein two ends of the second segment in each of the partial circuits are electrically coupled to the two of the first segments in the same one of the partial circuits, respectively, and wherein each of the second segments is electrically coupled to one of the phase shifters.

8. A common antenna structure, comprising:

a substrate defining a first direction and a second direction that is perpendicular to the first direction;

a plurality of patch antennas uniformly distributed on the substrate, wherein the patch antennas are arranged along the first direction and the second direction, and the patch antennas are defined into a plurality of antenna units that are arranged in a plurality of rows or a plurality of columns, wherein each of the antenna units includes four of the patch antennas arranged in two rows parallel to the first direction and two columns parallel to the second direction, wherein in the antenna units of any one of the rows parallel to the first direction, any two of the antenna units adjacent to each other jointly share a longitudinal common antenna unit that is defined by two adjoining ones of the patch antennas, and the longitudinal common antenna unit is arranged along the second direction, and wherein in the antenna units of any one of the columns parallel to the second direction, any two of the antenna units adjacent to each other jointly share a horizontal common antenna unit that is defined by two adjoining ones of the patch antennas, and the horizontal common antenna unit is arranged along the first direction; and a plurality of phase shifters respectively and electrically coupled to the antenna units, so that each of the phase shifters is capable of being used to adjust phases generated from the four of the patch antennas of the corresponding antenna unit, and wherein a number of the phase shifters is equal to a number of the antenna units.

9. The common antenna structure according to claim 8, wherein in the antenna units of any one of the rows parallel to the first direction, center points of any two of the antenna units adjacent to each other are spaced apart by a horizontal center distance along the first direction, wherein in the antenna units of any one of the columns parallel to the second direction, center points of any two of the antenna units adjacent to each other are spaced apart by a longitudinal center distance along the second direction, and wherein the horizontal center distance is equal to the longitudinal center distance.

10. The common antenna structure according to claim 9, wherein the common antenna assembly is suitable for a transmission frequency band, and each of the longitudinal center distance and the horizontal center distance is 0.5 to 0.8 times of a wavelength corresponding to a center frequency of the transmission frequency band.

* * * * *